United States Patent [19]

Brower

[11] Patent Number: 5,022,098

[45] Date of Patent: Jun. 11, 1991

[54] AUTOMATIC, SELF-CLEANING, WATER SAVING, TOILET SYSTEM

[76] Inventor: Richard Brower, 14324 Marianopolis Way, San Diego, Calif. 92129

[21] Appl. No.: 430,273

[22] Filed: Nov. 2, 1989

[51] Int. Cl.[5] ..... A47K 13/00

[52] U.S. Cl. ..... 4/233; 4/319; 4/320

[58] Field of Search ..... 4/233, 320, 319

[56] References Cited

U.S. PATENT DOCUMENTS

| | | | |
|---|---|---|---|
| 2,104,947 | 1/1938 | Joosten | 4/233 X |
| 3,329,974 | 7/1967 | Belosco et al. | 4/320 X |
| 3,381,312 | 5/1968 | Whitla | 4/233 X |
| 3,727,241 | 4/1973 | Drouhard et al. | 4/319 |
| 3,919,726 | 11/1975 | Godwin et al. | 4/662 X |
| 4,156,297 | 5/1979 | Pilolla | 4/320 |
| 4,729,133 | 3/1988 | Wileman | 4/233 |

*Primary Examiner*—Charles E. Phillips
*Attorney, Agent, or Firm*—Frank D. Gilliam

[57] ABSTRACT

A toilet system providing improved convenience, efficiency and sanitation with automatic operation. Basically, the toilet includes a bowl, a seat partially covering the bowl opening and a lid movable between a raised position exposing the seat and a lower position covering the seat sealing the bowl. When the lid is raised, an air extraction system removes air and odors from the bowl. After use, the lid is either manually or automatically closed, initiating a high or low flush. When left to close automatically a low flush only is initiated. In a low flush, water is directed under pressure through two rotating spray jets against the bowl interior, then is removed along with any toilet contents by the rotating jets action and the macerator which reduces solids to small particles. Heated air is then directed into the bowl to dry the bowl. In a high flush, an additional spray jet cleans the seat and a larger quantity (typically ⅓ additional) of water is used. The water saver design eliminates the need for drain openings under the bowl rim. The macerator is mounted at an angle below horizontal line and secured to a bowl tapered receiving area. The bowl interior remains free of any standing water.

7 Claims, 4 Drawing Sheets

AUTOMATIC, SELF-CLEANING, WATER SAVING, TOILET SYSTEM

BACKGROUND OF THE INVENTION

This invention relates in general to toilets and, more specifically, to high efficiency self cleaning toilets.

A wide variety of toilets having various features have been developed over the years. Many attempts have been made to reduce the amount of water required for flushing, in order to reduce water consumption and to reduce the quantity of water going to sewer treatment facilities. Others have designed toilets which extract air from the toilet bowl during use to avoid unpleasant odors. Devices have been added to toilets to comminute solid waste to reduce flushing water requirements and sewer clogging problems. Toilet seats incorporating resistance heating elements to warm the seat on cold days have been conceived. Attempts have been made to refine toilet bowl and seat design to reduce manual cleaning requirements and improve sanitation.

Despite these varied features and design ideas, almost all toilets presently in use in homes and businesses are of the standard type which uses gravity flow of several gallons of water from an elevated tank to flush the toilet and which retain a quantity of water in the bowl to seal the outlet to the sewer. None of the individual convenience features mentioned above have come into widespread use.

Thus, there is a continuing need for improved toilets providing greater efficiency in water use, greater convenience and improved sanitation.

SUMMARY OF THE INVENTION

The above-noted problems, and others are overcome in accordance with this invention by an improved toilet which combines a number of improved features into an automatically operating system.

The toilet system uses a bowl of generally conventional shape, but without the water drain opening under the rim. A hinged seat and lid surrounds the upper surface of the bowl and are movable between an upper, open, position and a lowered position. The lid is in sealing contact with the bowl rim.

An air extraction system pulls air from within the bowl when the lid is up and passes the air to the conventional toilet outside vent. This system also circulates drying air during the cleaning cycle, described below.

After the toilet is used, either a low or high flush is selected. Low flush is ordinarily selected only when there are no solids in the bowl. This automatic sequence includes lowering and latching the lid, spraying a high pressure rotating spray of water against the bowl surface, removing the liquid and drying the bowl with warm air. Where solids are present, high flush is usually selected. Then, a larger quantity of water is used with an additional high pressure spray being directed against the seat. Bowl contents pass through a macerator to reduce solids to small particles and the contents are ejected to the sewer. Warm air is circulated through the toilet to dry the seat and bowl. A small quantity of the circulated air is exhausted to the room area during the drying cycle.

Where the lid is left up after use, the system preferably includes means to automatically close the lid and start the low flush sequence after a few minutes. The time is controlled by air bleed past the piston seal of a lid cylinder.

In order to assure complete and effective cleaning, means are preferably included to meter an appropriate quantity of a cleaning agent into the flushing water flow.

While this toilet is intended for use in homes, businesses, public restrooms and the like, it is particularly adapted for use in yachts, motorhomes, travel trailers and the like where the limited water usage and reduction of solids to fine particles increase the capacity of holding tanks and make later pumping out of dumping of the holding tank at a dump station especially convenient.

BRIEF DESCRIPTION OF THE DRAWING

Details of the invention, and preferred embodiments thereof, will be further understood upon reference to the drawing, wherein.

DETAILED DESCRIPTION OF PREFERRED EMBODIMENTS

Figure 1:
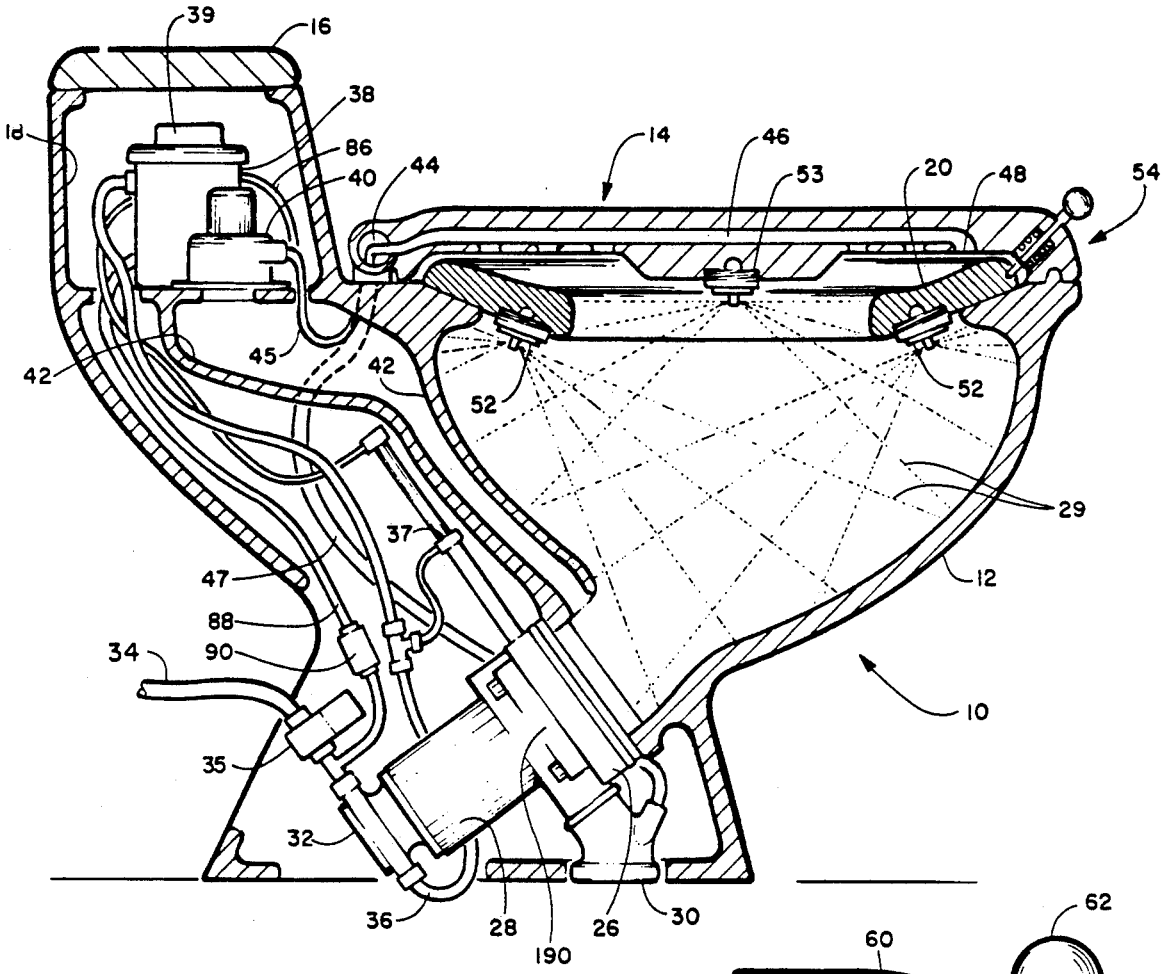
FIG. 1 is side elevation section view, taken along the centerline, of the toilet of this invention.

Referring now to FIG. 1, there is seen a schematic vertical section through toilet 10. The exterior of toilet 10 basically includes a bowl 12, lid 14 and a cover 16 over the equipment space 18. Bowl 12 has the usual upper opening encircled by a seat 20 of conventional shape. The bottom of the bowl 12 is tapered toward an opening (typically having a diameter of about 3.5 in) downward at an angle, typically 55°, from horizontal.

In place of the usual water filled syphon drain at the bottom of the toilet bowl, the system provides a combination macerator (as shown in detail in FIGS. 9–12) and ejector within housing 26. Housing 26 is partially cutaway to show slide valve blade 37 as detailed below solid waste from toilet bowl 12 enters macerator 190 where it is comminuted into fine particles, then together with liquid waste it is ejected out through exit pipe 30 to the usual sewer or holding tank, not shown.

Figure 4:
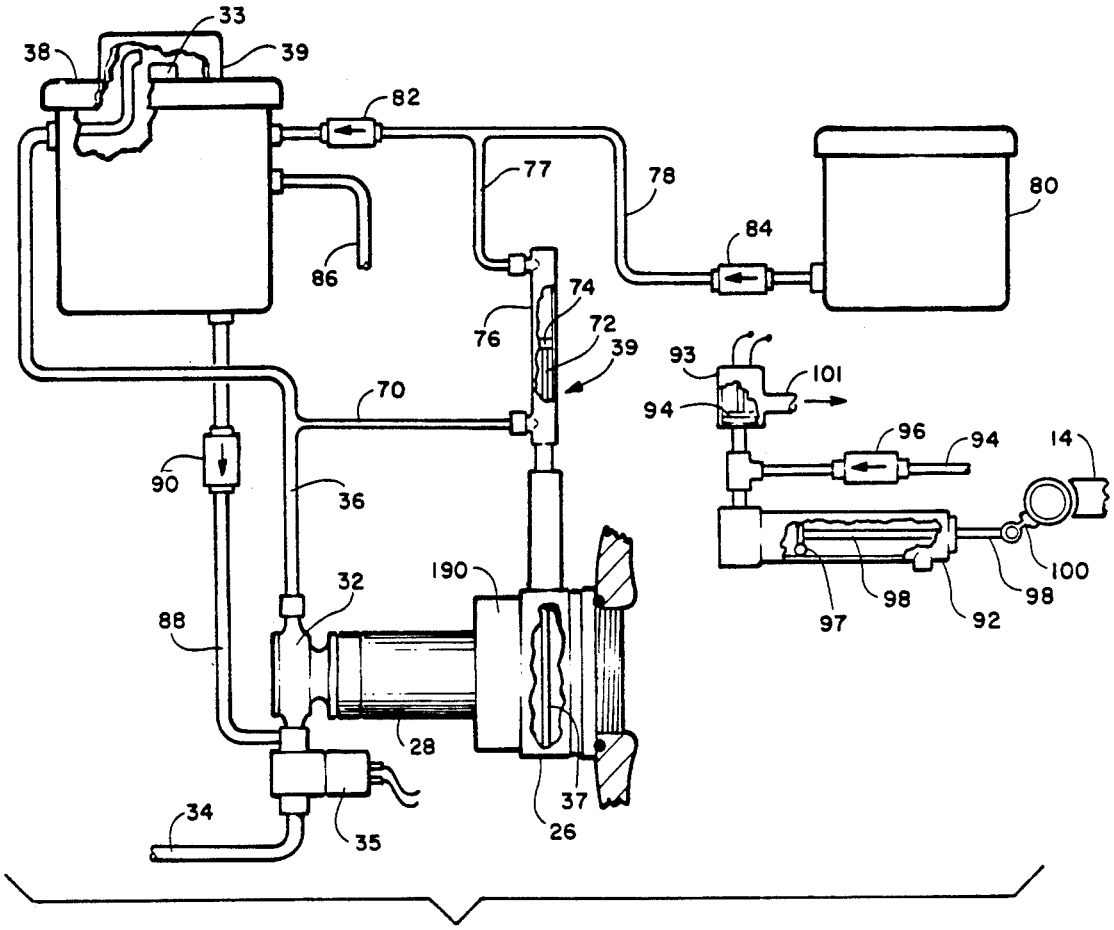
FIG. 4 is a schematic diagram of the fluid flow and hydraulic system used in this toilet system.

Motor 28 also drives a water pump 32 at its opposite end. Pump 32 receives water from an inlet line 34 (which may be at low pressure) when solenoid valve 35 is opened. Water at pump 32 output pressure moves through line 36 to a container 38 and a slide valve actuation mechanism, as will be described in greater detail in conjunction with the description of the fluid flow system as shown in FIG. 4.

Figure 8:
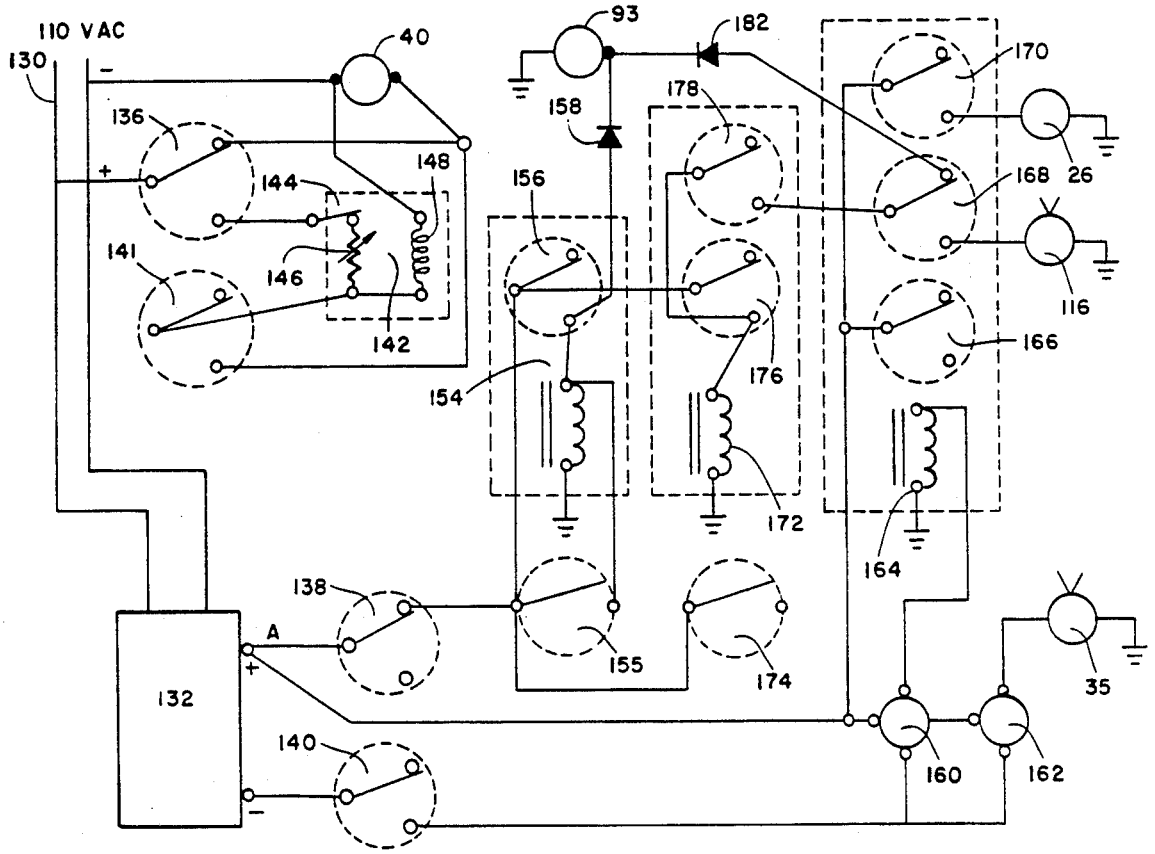
FIG. 8 is a schematic diagram of the electrical circuit for operating the toilet system.
Figure 9:
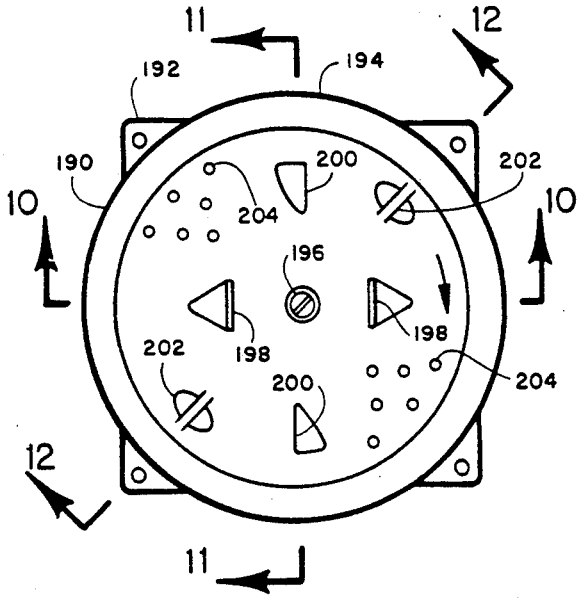
FIG. 9 is a detail plan view of the macerator taken along line 9—9 in FIG. 1.

Returning to FIG. 1, an air pump 40 resides in compartment 18. Pump 40 is basically a blower, adapted to pull air from bowl 12 through conduit 42 and direct air under pressure into manifold 44 (shown in detail in FIG. 6) through tube 45. Depending upon the position of lid 14, air will flow either to exit pipe 30 through tube 47, (thence to the conventional root vent provided for toilet 10) or through tube 46 within lid 14 to a plurality of openings 48. The operation of manifold 44 will be detailed in conjunction with the descriptions of FIGS. 6 and 8, below. As detailed below, the air flow through openings 48 may be heated to dry seat 20 and the interior of bowl 12 after flushing.

In order to clean the interior of bowl 12 and/or seat 20 after the toilet is used, water from inlet line 34 is pumped to container 38 which contains a selected quantity of a sanitizing chemical. Contained in the air gap area 39 of container 38 in pellet form. Depending on the flush mode selected, as described below, water will flow from container under pressure to under seat spray nozzles 52 to clean the interior of bowl 12, or to both spray nozzles 52 and one nozzle 53 on inside lid 14 to also clean seat 20. This water will flow down over seat 20 and the interior of bowl 12 to the macerator and ejector within housing 26. This water will be ejected to the sewer line through exit pipe 30.

Figure 2:
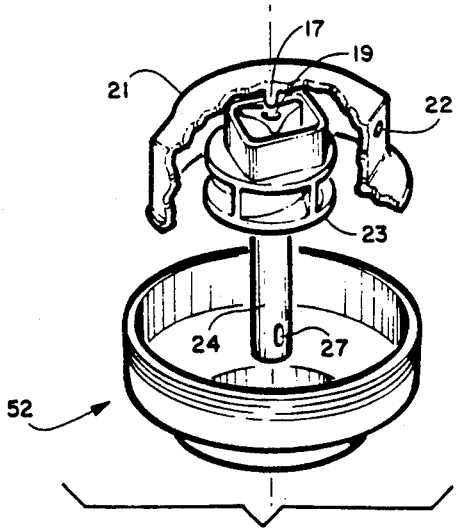
FIG. 2 is a detail exploded view, partially cut-away, of the spray head assemblies.
Figure 5:
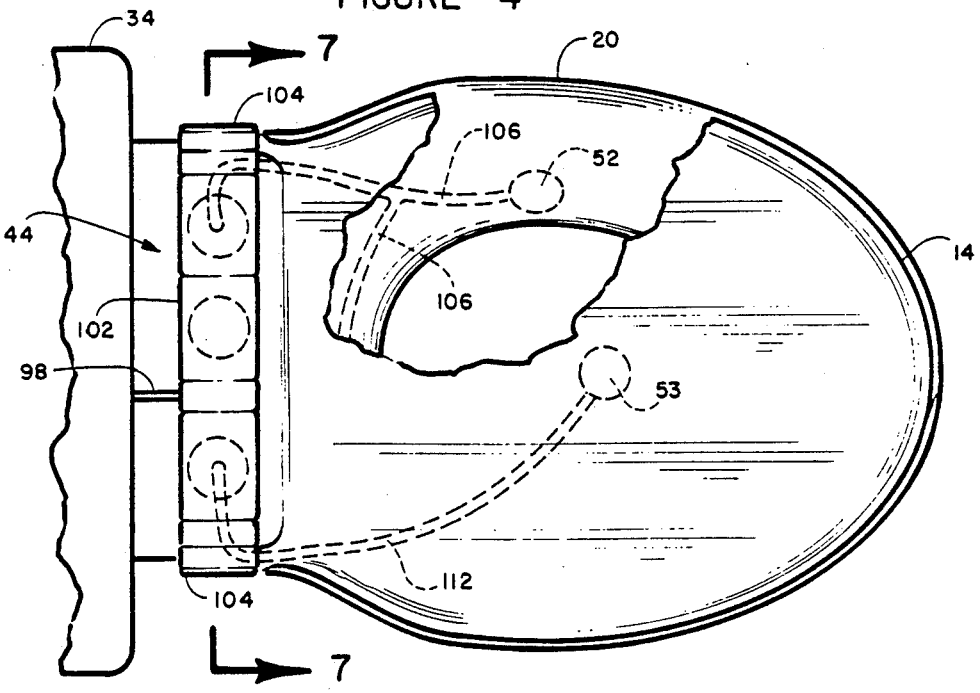
FIG. 5 is a plan view, partially cut-away, of the bowl indicating the location of the spray system.

While two nozzles 52 are shown in FIG. 1 at the front and back of bowl 12, they are preferably placed at the sides as shown in FIG. 5. Spray nozzles 52 are shown in detail in the exploded view of FIG. 2. Water enters cap 21 through a plurality of holes 22. Water flow spins the downwardly extending tube 24 through impeller 23. Water flows into tube 24 through impeller 23 and out through openings 27 in a moving, wide spread narrowly directed fan, spray pattern as indicated by droplet patterns 29 as seen in FIG. 1. Lid nozzle 53 is of the same configuration as nozzles 52. Nozzles 52 as mounted, rotate in opposite direction inward toward macerator forcing any waste within bowl 12 into the macerator 190 opening. A pin 17 inside cap 21 fits loosely in hole 19 in impeller assembly 23 to stabilize the impeller during rotation.

Figure 3:
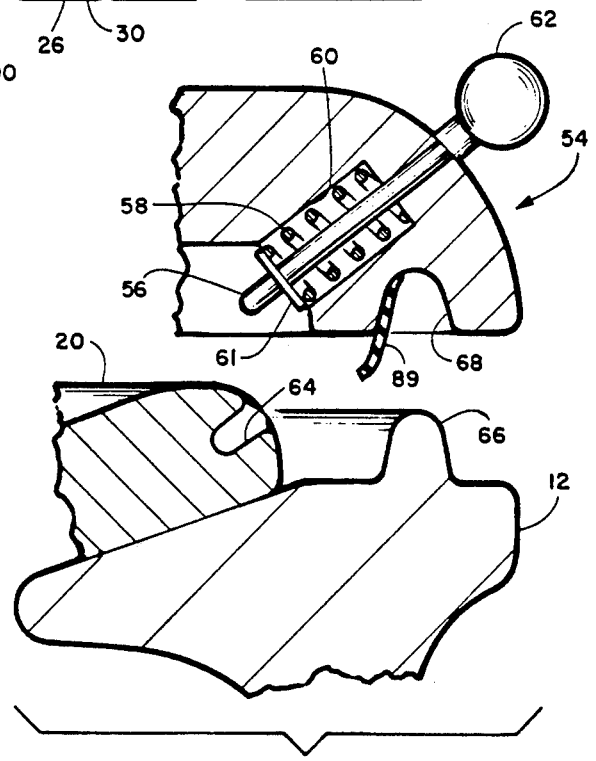
FIG. 3 is a detail section view showing the lid latching mechanism.

When lid 14 and seat 20 are closing the seat and lid are latched together to prevent the seat from free falling to the down position. FIG. 3 provides a detail section view of the latch mechanism 54 nearly closed.

Latch 54 includes a plunger 56 surrounded by a compression spring 58, located within a recess 60 in lid 14. A disk 61 is secured to plunger 56 and bears against spring 58. A knob 62 on the outside end of plunger 56 prevents the plunger from being pushed through the lid and provides means for manually retracting plunger 56 when lid 14 only is to be moved to the open position. As lid 14 moves downwardly during closure, the end of plunger 56 encounters the upper edge of recess 64 in seat 20, which presses plunger 56 back against spring 58 until the plunger snaps into recess 64. A mating rim 66 and channel 68 with a sealing strip of flexible material 69 are provided in the edges of lid 14 and bowl 12 to assure proper engagement of lid to bowl and seat and to further assure that water cannot leak between lid and bowl rim during flushing, as described below.

The fluid flow system for toilet flushing and the lid lowering hydraulic system are schematically illustrated in FIG. 4.

Fresh water enters through line 34 and solenoid valve 35 to water pump 32. Motor 28 drives pump 32 to pump water at the desired pressure through line 36 to container 38.

A second line 70 directs pressurized water to slide valve mechanism 39. A conventional slide valve (not shown) within housing 26 is movable transverse to the pump axis between a closed position separating the interior of bowl 12 from macerator 190 and the open position. The slide valve is connected by a rod 72 to a piston 74 within cylinder 76. Rod 72 is spring biased in a downwardly, closed, direction. Pressurized water entering the lower end of cylinder 76 forces piston 74 upwardly, overcoming the spring closing force.

As piston 74 moves upwardly in cylinder 76, it forces a metered quantity of cleaning and deodorizing chemical concentrate up through tube 77 into tube 78. Tube 78 is filled with the liquid cleaning and deodorizing liquid from reservoir 80. One "shot" of the concentrate is forced past check valve 82 into container 38. Check valve 84 prevents the liquid being forced back into reservoir 80 and check valve 82 prevents water from tank 39 entering line 77. When the system is later shut down, water pressure on piston 74 will be relaxed, allowing the piston to return to the bottom of cylinder 76 under the influence of the valve closing spring (not shown). This will "pull" another "shot" of cleaning agent from reservoir 80 into tubes 77 and 78 between check valves 82 and 84.

Water forced through tube 36 by pump 32 will enter container 38, mixing with the cleaning agent entering through tube 78. Pellets of chlorine chemical 33 are placed in container 38 partially cut-away air gap cap 37 to be partially dissolved each time water is introduced thereinto. Pressurized water, mixed with cleaning agents and the like, passes from container 38 and cap 39 through tube 86 to manifold 44 and then to spray nozzles 52 and 53. Line 36 protrudes into the cap and water flows over the pellets. Container 38 is pressured by the incoming water.

A water return line 88 with check valve 90 provides circulation to pump 32 to hold slide valve mechanism 39 in the open position for the required short drain period after water inlet valve 35 is closed and the system shuts down.

When lid 14 is raised, mechanical linkage 100 moves piston 97 of cylinder 92. Check valve 96 allows air to enter air cylinder 92 through line 94 from the atmosphere. Air is trapped within the cylinder 92 by check valve 96 one way action. The extending rod 98 and crank 100 hold lid 14 in the "up" position. When partially cut-away air solenoid valve 93 is energized (as when a flush operation is selected) valve plunger 99 moves upwardly so that the lid 14 will slowly and smoothly lower by the gravity air being released to atmosphere through exhaust tube 101. When left unattended with lid up, leakage of air past the piston of cylinder 92 or through solenoid valve 93 after several minutes will lower the lid. Details of the fluid control manifold 44 are provided in FIGS. 5–7. Manifold 44 acts as a valve system for directing air flow to bowl 12, as a conduit for the tubes conveying water to spray nozzles 52 and 53 and as the hinge for lid 14.

Figure 6:
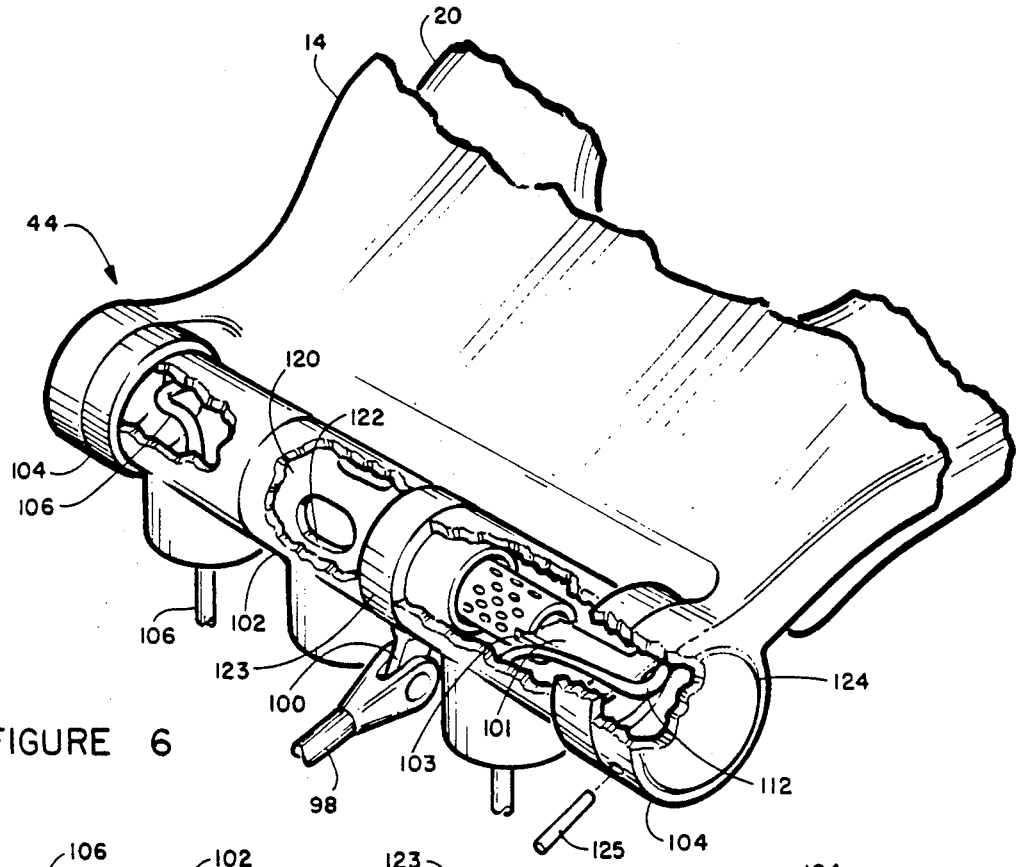
FIG. 6 is a perspective view, partially cut-away, showing the lid hinge and valve system.

As best seen in FIG. 6, the central portion 102 is stationary and fastened to bowl 12 adjacent to compartment 18. Rings 104 overlap the ends of central portion 102. One ring 104 is secured to lid 14, and the other ring is secured to the seat. The lid ring is keyed to rotary valve 120. The seat ring serves as a hinge and floats on rotary valve 120.

Water line 104 from container 38 (FIG. 1) enters air conduit 108 through a fitting 110 (FIG. 7), passes along the central portion 102 of manifold 44 (FIG. 6, 7) into openings in seat 20 and finally bifurcates to reach spray nozzles 52 (FIG. 5). As mentioned above, spray nozzles 52 may, as desired, be located at the front and back of bowl 12 as shown in FIG. 1 or at the sides of bowl 12 as shown in FIG. 5, or any other selected location in the underside of seat 20.

A water line 112, generally similar to line 106, runs from container 38 through fitting 114, through end ring 104 and an opening in lid 14 to spray nozzle 53 in the underside of lid 14. A solenoid valve 116 (FIG. 7) is provided in line 112 so that line, which is pressurized whenever pump 32 (FIG. 1) is on, is opened only when a high flush is called for, as detailed below.

Figure 7:
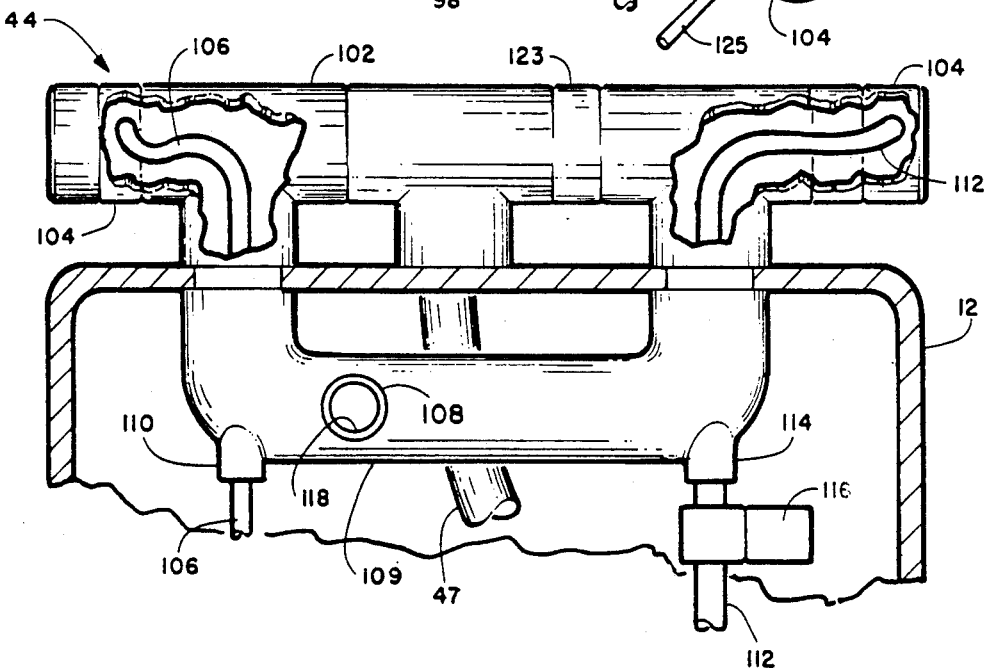
FIG. 7 is a section view, partially cut-away, taken on line 7—7 in FIG. 5.

Referring now primarily to FIGS. 6 and 7, air is introduced into conduit 108 through opening 118 which receives pressurized air (which may be heated) from air pump 40 (FIG. 1). The air flows into the axial opening in central portion 102 to a rotary valve 120. When lid 14 is up, an opening 122 is aligned with exhaust tube 47 which directs the air to the sewer vent through exit pipe 30 (FIG. 1) to create a slight vacuum in bowl 14 and exhaust air and any odors from the bowl. Ring 123 is secured to rotary valve 120 and to lid 14, so that valve 120 is rotated when rod 98 and crank 100 are operated during the lid 14 up movement.

Opening 122 is fractionally misaligned with tube 46, causing a portion of the recirculating air to be exhausted to room area creating a slight vacuum in bowl 12 and drawing in a small portion of fresh outside air past the cover 18, seal seen in FIG. 7.

Manifold 44 may be assembled and secured together in any conventional manner. End caps 124 on rings 104 are removable and held in place by a locking pin 125 through ring 104. The cap 104 includes an internal key 101 which engages slot 103 in the rotary valve to direct air as dictated by the lid position. The schematic diagram of the electrical circuits of the control system and timer circuit are provided in FIG. 8. A wall outlet 130 provides 110 volt power to the system. A transformer and rectifier 132 provides 12 volt direct current for the two timers, each of which uses the timer circuit 134.

A ganged switch which is operated by lid movement between open and closed positions includes heater air switches 136, 141 a flush arm switch 138 and a timer start switch 140. Switch 136 activates air pump 40 alone in the lid up position. Heater assembly 142 includes a heater switch 144 which is closed when heated air is required for drying the seat and bowl interior. An adjustable heater temperature control 146, a heater coil 148 are also included in heater assembly 142. Thus, when heater switch 144 is armed and closed, heated air is blown through tube 46 (FIG. 1) to dry the seat and bowl.

Air cylinder valve 93 (FIG. 4) is energized when a flush switch, either switch 155 or switch 174, is selected and is momentarily pressed. Switches 155 and 174 are conventional manual switches which could be placed in any suitable location, such as in or on the top of tank 16. Relay 154 and switch 156 allow current to flow through diode 158 to valve 93. Switch 138 is closed when lid 14 is up and will remain closed to hold air valve 93 to open until the lid is fully down. The lid will smoothly and automatically close after a few minutes, when left unattended. However, manual pressing of either flush switch 155 or 174, will lower the lid in seconds and a flush cycle begins.

Two timers using the circuit 134 are provided, a motor timer 160 and a water valve timer 162. Timer 162 simply turns water inlet solenoid valve 35 on and off at the appropriate time. The time cycle is identical for both the high and low flush.

Motor timer 160 operates motor relay 164 to close switches 166, 168 and 170. Switch 166 along with switches 176, 178 and 168 operates solenoid valve 116 (FIG. 7) to allow water flow to the under lid spray nozzle 53, when a "high flush" has been called for, by the closing of relay 172. Switch 166 powers relay 172 switch 166 powers relay 172 to maintain relay contact after lid down opens switch 138.

Low flush relay 154, as discussed above, simply controls the lid air valve 93, to lower the lid which automatically starts the selected flush and the drying cycle.

High flush relay 172, when activated by high flush switch 174, closes 178 to activate solenoid valve 93 through switch 178, 168 and diode 182. The lid lowers in seconds and switch 140 triggers the timer into action. Timer 160 closes relay 164 and relay contact switch 166 provides alternate power to the high flush relay 172 before switch 138 is deactivated by the lid closing. Through switches 166–172 switch 168 at full lid down activates water nozzle valve 116 to allow water flow to the seat-cleaning area. Switch 170 operate the motor 26. Timer 162 controls the water cycle and timer 160 controls the motor 26.

Each timer 134 consists of a conventional timer circuit using a suitable integrated circuit 184 to operate a relay 186. A preferred integrated circuit is available from the commercial suppliers under the "555" designation.

A person using the toilet will select either a "low flush" which typically only use about 3 pints of water but does not clean the seat or a "high flush" which uses only about 3 quarts of water and cleans and dries the seat. Ordinarily a low flush will be selected if the seat is clean and no solids are in bowl 12.

Figure 10:
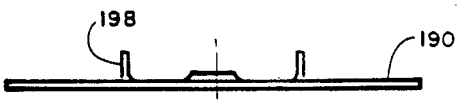
FIG. 10 is a detail section view taken on line 10—10 in FIG. 9.
Figure 11:
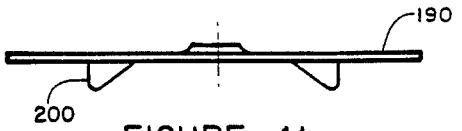
FIG. 11 is a detail section view taken on line 11—11 in FIG. 9.
Figure 12:
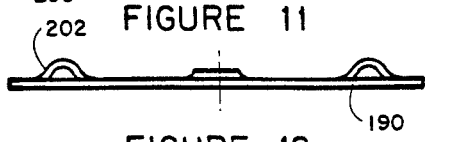
FIG. 12 is a detail section view taken on line 12—12 in FIG. 9.

Details of macerator 190 are provided in FIGS. 9–12. The mounting plate 192 is part of the macerator housing 26, as seen in FIG. 1. A fragmentation ring 194 is mounted in the housing 26. A disk is mounted to the end of the threaded shaft of motor 28 for rotation with the motor shaft. The two upstanding tabs 198, serve as ejectors to the sewer system. Tabs 200 and 102 having different shapes as seen in FIGS. 10–12 impact and break up an solid material brought into contact with the disk by the flow of water out of the bowl. Fine particles and the water pass through a plurality of holes 204, to the sewer drain pipe 30.

While certain specific material, arrangements and configurations of components were described in detail in conjunction with the above description of a preferred embodiment, those may be varied, where suitable, with similar results. Other applications, variations and ramifications of this invention will occur to those skilled in the art upon reading this disclosure. Those are intended to be included within the scope of this invention, as defined in the appended claims.

I claim:

1. A toilet having improved efficiency, convenience and sanitation which comprises:

a bowl;

a seat partially covering the upper surface of said bowl;

a lid movable between a down position engaging said seat and sealing the bowl interior and an up position away from said seat permitting use of said toilet;

air extraction means including an air pump adapted to receive air from within said bowl and selectively direct said air through a first tube to an outside vent or to a second tube exiting in said bowl when said lid is up during toilet use;

flushing means for directing a variable quantity of water under pressure into said bowl;

a plurality of rotating spray means for spraying water across said seat and interior surface of said bowl during flushing;

means for removing any contents from said bowl and reducing solids to small particles during flushing;

a heater to heat air passing through said air pump and means to activate said heater when air is directed through said second tube;

means for directing heated air across said seat and said bowl interior upon completion of flushing to dry said bowl and seat and to warm said seat;

a rotary valve means connected to said lid adapted to receive air from said air pump and movable between a first position corresponding to the lid up position for directing air to said vent and a second position corresponding to the lid down position for directing air through said second tube toward said seat and bowl interior; and exhaust means to direct said heated air to and external vent.

2. The toilet according to claim 1 further comprises a reservoir for holding a quantity of cleaning and/or deodorizing concentrate, a container for holding a quantity of water to be used as a mixing chamber, means for introducing a selected quantity of concentrate into said container and means for adding said selected quantity of concentrate into the flush water.

3. The toilet according to claim 1 further including means for producing a flush with a low quantity of water which includes means for directing water flow to spray means adapted to spray the interior of said bowl.

4. The toilet according to claim 1 further including timer means for producing a flush with a higher quantity of water which includes means for directing water to flow to spray means adapted to spray both said seat and the interior of said bowl.

5. The toilet according to claim 1 wherein said air extraction means includes an air pump adapted to receive air from within said bowl and selectively direct said through a first tube to an outside vent or to a second tube exiting in said bowl.

6. The toilet according to claim 1 wherein said means for removing bowl content and reducing particle size comprise a macerator means for comminuting solids and an ejector for directing the mixture of particles and water to a sewer line.

7. The toilet according to claim 6 further including a valve means positioned between said bowl an macerator, adapted to open during flushing and to close and seal said bowl upon completion of flushing.

* * * * *